United States Patent [19]

Ryu

[11] Patent Number: 4,666,328

[45] Date of Patent: May 19, 1987

[54] POSITIONING JOINT FOR FOLDING LADDERS

[75] Inventor: Hoe K. Ryu, Seoul, Rep. of Korea

[73] Assignee: Woo Kyong Industrial Co., Ltd., Seoul, Rep. of Korea

[21] Appl. No.: 894,049

[22] Filed: Aug. 7, 1986

[30] Foreign Application Priority Data

Mar. 4, 1986 [KR] Rep. of Korea ..... 2527/86

[51] Int. Cl.[4] ..... E05D 11/10

[52] U.S. Cl. ..... 403/92; 403/93; 16/329; 16/344; 182/23; 182/163

[58] Field of Search ..... 403/91, 92, 93, 101, 403/102, 100; 16/329, 330, 331, 332, 334, 344; 182/24, 23, 163

[56] References Cited

U.S. PATENT DOCUMENTS

| | | | |
|---|---|---|---|
| 4,152,810 | 5/1979 | Martinez | 403/92 X |
| 4,216,844 | 8/1980 | Klafs | 16/329 X |
| 4,377,020 | 3/1983 | Vigo | 16/329 |
| 4,407,045 | 10/1983 | Boothe | 182/163 X |
| 4,543,007 | 9/1985 | Quiogue | 403/93 X |
| 4,566,150 | 1/1986 | Boothe | 182/163 X |

*Primary Examiner*—Cornelius J. Husar
*Assistant Examiner*—Joseph A. Fischetti
*Attorney, Agent, or Firm*—Watson, Cole, Grindle & Watson

[57] ABSTRACT

A positioning joint for a folding ladder comprising a first joint member, a second joint member disposed between the first joint member, and a hollow shaft inserted into central holes of the first and second joint members. The joint further includes a turning plate disposed on an inner wall of a first disc portion of the first joint member, a crank-shaped strip, and a spring mounted around the hollow shaft. A push knob is inserted into the hollow shaft, and a pin is inserted into a pair of axially elongated holes in the hollow shaft and into a pin hole in the push knob. The crank-shaped strip has a pair of small projections adapted to be inserted into engaging holes of the first and second joint members as well as a pair of large projections adapted to be inserted into the first and second joint members and the turning plate. The crank-shaped strip also has a central portion fixed between the hollow shaft and the spring.

2 Claims, 6 Drawing Figures

POSITIONING JOINT FOR FOLDING LADDERS

BACKGROUND OF THE INVENTION

This invention relates to a positioning joint for a folding ladder.

In a conventional positioning joint for a folding ladder, the folding or unfolding of the ladder to a desired angular position is performed by aligning holes in side discs and inserting a pin into holes in the discs. A joint of this type has the disadvantage that it is difficult to quickly align the holes in both side discs.

Another prior art joint for a folding ladder utilizes a ratchet which causes users to be concerned about the safety of such a joint because of potential malfunctions of the ratchet.

SUMMARY OF THE INVENTION

Accordingly, it is a principal object of the present invention is to provide an improved positioning joint for a folding ladder which will reduce or eliminate the aforesaid defects and insure safety in use while at the same time will be easy to operate.

According to the present invention, there is provided a positioning joint for a folding ladder comprising a first joint member having a tubular portion and two spaced first and second disc portions each having a central bore, a second joint member having a tubular portion and a disc portion with a central bore, the disc portion of the second joint member being disposed between the disc portions of the first joint member and comprising first and second sidewalls, a hollow shaft inserted into the central bores of the disc portions of the first and second joint members, a turning plate between an inner wall of the first disc portion of said first joint member and the first sidewall of the disc portion of the second joint member, said turning plate having a plurality of engaging holes formed in alignment with engaging holes circumferentially distributed in the first disc portion of the first joint member and having an arcuate hole into which a projection on the first disc portion of the first joint member projects, the second disc portion of said first joint member having a plurality of engaging holes formed in a reinforcing rim, said disc portion of the second joint member having a pair of engaging holes in the first sidewall facing the turning plate such that they can align with engaging holes of the turning plate and having a pair of overlapping double holes in the second sidewall such that its radially innermost hole aligns with the engaging hole of said first sidewall, said hollow shaft having a spring about itself by which a central portion of a crank-shaped strip is fixed and having a pair of axially elongated holes, a push knob inserted into said hollow shaft, said push knob having a pin hole into which a pin is inserted in alignment with said axially elongated holes, said crank-shaped strip having a small projection on each end which is adapted to be inserted into said engaging holes of the reinforcing rim and the outer portion of said overlapping double holes and having a pair of large projections radially inwardly from said small projections, the large projections each adapted to be inserted into the inner portion of said overlapping double holes and in said engaging hole of the first sidewall of the disc portion of the second joint member and corresponding engaging holes of the turning plate and corresponding engaging holes of the first disc portion of the first joint member, and a spring between said turning plate and the first disc portion of the first joint member.

Other features of the present invention will become apparent from the following detailed description taken in conjunction with accompanying drawings.

DETAILED DESCRIPTION OF THE INVENTION

Figure 1:
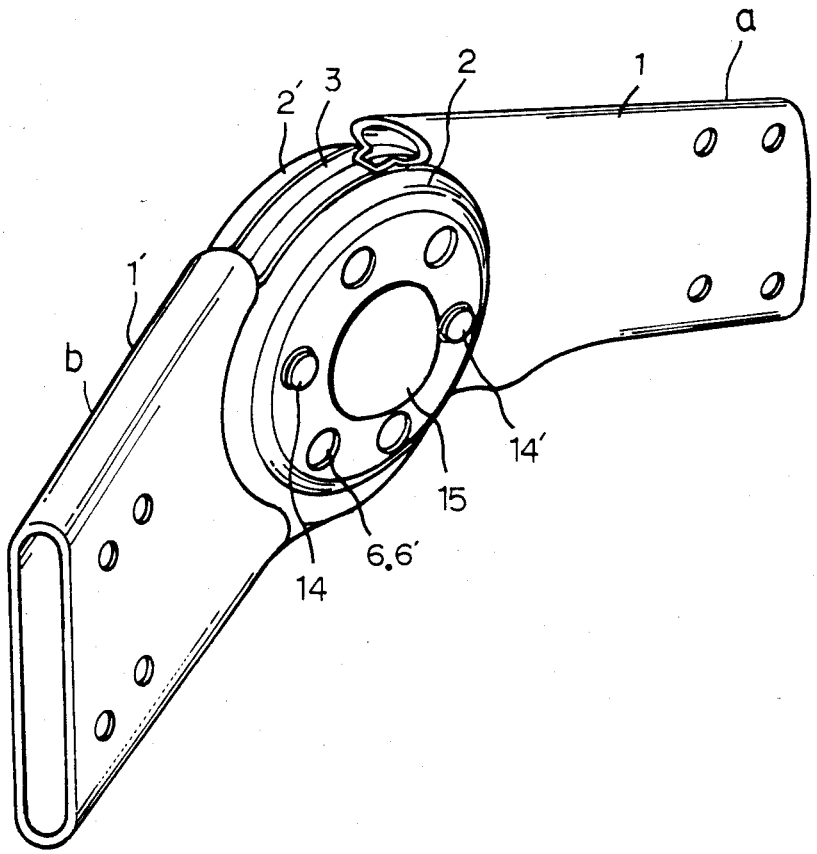
FIG. 1 is a perspective view of the positioning joint for a folding ladder according to the present invention.
Figure 2:
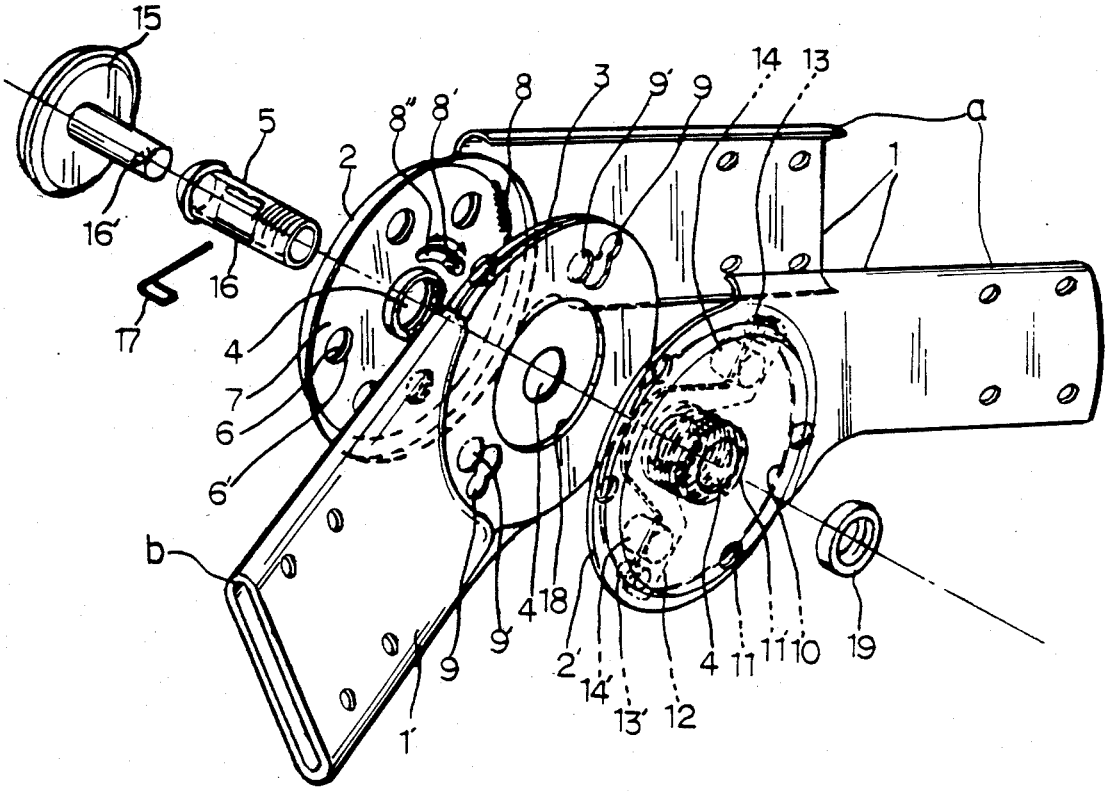
FIG. 2 is an exploded perspective view of the positioning joint for a folding ladder according to the present invention.

The positioning joint for a folding ladder according to the present invention comprises, as shown in FIGS. 1, 2, 5 and 6, first joint member a and second joint member b. First joint member a is somewhat similar to a conventional joint member, i.e., it may be formed, for example, of sheet metal pressed into first and second disc portions 2 and 2' and tubular portions 1 and 1'. Second joint member b may be also formed of sheet metal pressed into hollow disc portion 3 and tubular portion 1''.

Disc portion 3 of second joint member b is formed by two side walls 3' and 3'' such that it is hollow, the disc portion being disposed between first and second disc portions 2 and 2' of first joint member a. The first and second joint members a and b each have a bore 4 in their central portion through which hollow shaft 5 is inserted.

On the inner wall of disc portion 2 is turning plate 6. Turning plate 6 is provided with a plurality of engaging holes 7 and arcuate opening 8. Engaging holes 7 of turning plate 6 are formed in alignment with engaging holes 9 which are circumferentially distributed in disc portion 2 of first joint member a. Inside arcuate hole 8 is projection 10 formed on disc portion 2 of the first joint member a. Spring 11 is provided between turning plate 6 and disc portion 2 of first joint member a to cause the plate to return to its original position.

Disc portion 3 of second joint member b is provided with two engaging holes 12 in side wall 3' facing turning plate 6 such that said engaging holes can align with the engaging holes 7 of turning plate 6 and engaging hole 9 of disc portion 2 of first joint member a. In addition, disc portion 3 of second joint member b is provided with two sets of overlapping double circular holes 13 in side wall 3'' such that its radially innermost holes align with the innermost ones of engaging holes 12 of turning plate facing side wall. Disc portion 3 of the second joint member b has bore 4 at its central portion of turning plate facing side wall 3' into which hollow shaft 5 is inserted. Also, this disc portion 3 of second joint member b has at its central portion of side wall 3'' a larger bore 14 in which crank-shaped strip 15 is moved.

Figure 5:
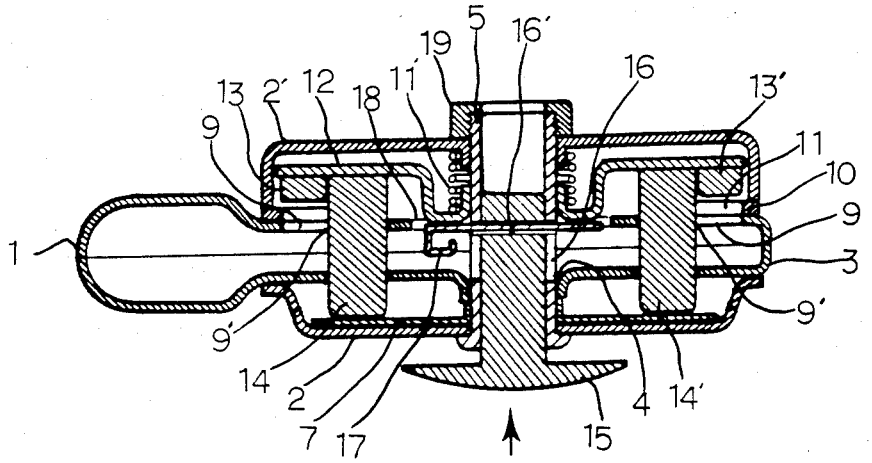
FIG. 5 is an enlarged sectional view of the positioning joint for a folding ladder according to the present invention showing the position in which the ladder is folded.
Figure 6:
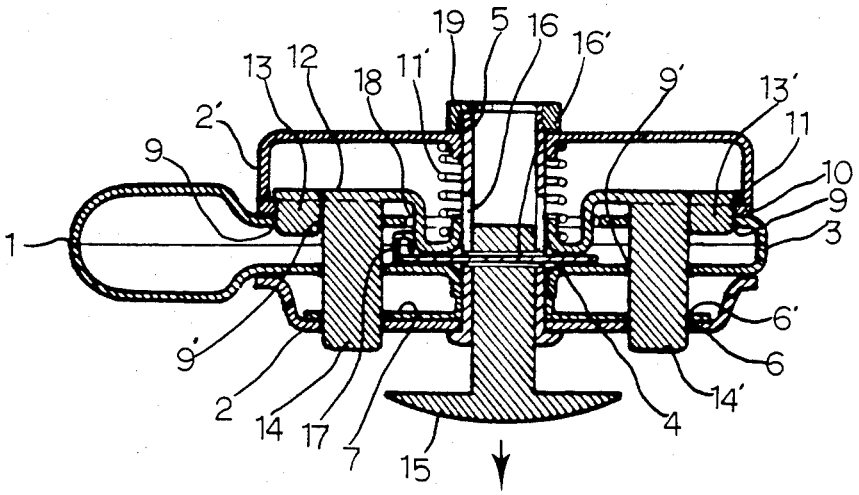
FIG. 6 is an enlarged sectional view of the positioning joint for a folding ladder according to the present invention showing the position in which the ladder is unfolded.

Strip 15 is formed of an elongated strip having a substantially crank-shaped cross-section. Central portion of strip 15 is held by a spring which is installed around hollow shaft 5. On the both ends of the crank-shaped strip 15 are formed a pair of small projections 16 which project toward disc portion 3 of second joint member b. A pair of large projections 17 is formed radially inwardly inside the both small projections 16. Small projections 16 are adapted to be inserted into a corresponding one among engaging holes 18 which are formed in reinforcing rim 19 made by bending the peripheral edge of disc 2' inwardly and also inserted into the outer portion of overlapping engaging hole 13 of disc portion 3 of second joint member b. Large projections 17 are adapted to be inserted into the inner portion of overlapping engaging holes 13 of the disc portion 3 and inserted into engaging holes 12 in sided wall 3' of disc portion 3 of second joint member b. Also, large projections 17 are adapted to be inserted into engaging holes 7 of turning plate 6 and into engaging hole 9 of the disc portion 2 of first joint member a. Inserted into hollow shaft 5 is push knob 20 having pin hole 21. Hollow shaft 5 has a pair of axially elongated holes 22. Pin 23 is inserted into elongated holes 22 and into pin hole 21, thereby maintaining the central portion of crank-shaped strip 15 in position. Hollow shaft 5 is provided with threads to be fastened with nut 24 on the end portion opposite to the end portion into which push knob 20 is inserted. As is best shown in FIGS. 5 and 6, spring 25 biases crank-shaped strip 15 toward push knob 20. In the interest of clarity, sectional views, FIGS. 5 and 6, are taken such that the slot and projection members 8 and 10, as well as spring 11 are not shown.

The positioning joint for a folding ladder according to the present invention is operated as follows.

Figure 3:
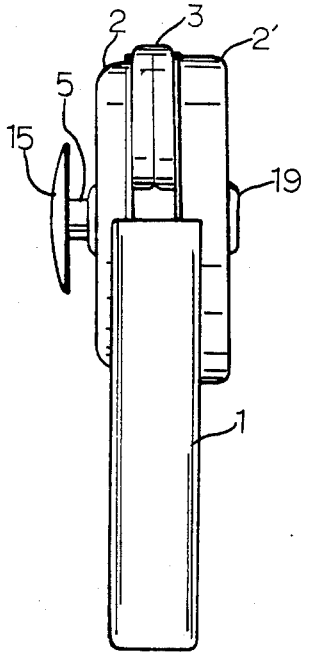
FIG. 3 is a side view of the positioning joint for a folding ladder according to the present invention showing the position in which the ladder is completely folded.
Figure 4:
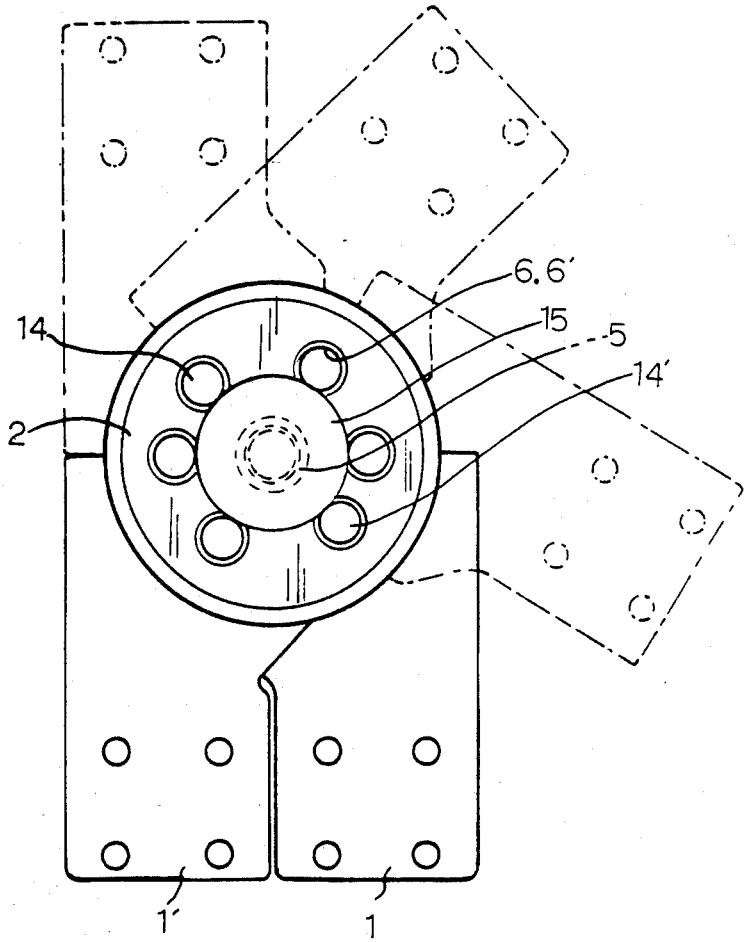
FIG. 4 is a front view of the positioning joint for a folding ladder according to the present invention illustrating the position in which the ladder maybe unfolded to a desired angle.

FIG. 3 and the solid lines of FIG. 4 illustrate the position of the joint in which a ladder would be completely folded. In this position, under the resilient force of the spring 25, small projections 16 of the crank-shaped strip 15 are located in a position being disengaged from the engaging holes 18 in reinforcing rim 19 and the large projections 17 are located in the inner portion of overlapping double engaging holes 13 and in engaging hole 12 of disc portion 3 of the second joint member b, and in engaging holes 7 of turning plate 6.

To unfold the ladder to an angle of 60° as shown in a dot and dash line in FIG. 4, both joint members a and b are pivoted with respect to each other. Upon pivoting joint members a and b about hollow shaft 5, large projections 17 located in the engaging holes 7 of turning plate 6 are inserted into the engaging hole 9 of disc portion 2 of the first joint member a under the resilient force of the spring 25 when the engaging hole of the turning plate in which large projections 17 are located comes into alignment with engaging hole 9 of disc portion 2 of first joint member a. In this position, small projections 16 are inserted into engaging hole 18 of reinforcing rim 19 and into the outer portion of overlapping double engaging hole 13 of disc portion 3 of second joint member b. At the same time, push knob 20 in hollow shaft 5 is urged to spring out by the central portion of the crank-shaped strip 15 through pin 23. In this situation, the ladder can be prevented from the further unfolding.

In order to unfold the ladder to an angle of 120° as shown in dot and dash lines in FIG. 4, push knob 20 is pushed first causing large projections 17 to be disengaged from engaging hole 9 of disc portion 2 of first joint member a and engaging hole 7 of the turning plate 6. At the same time, small projections 16 are disengaged from the outer portion of overlapping double engaging hole 13 of disc portion 3 of second joint member b and engaging hole 18 of reinforcing rim 19. Therefore, turning plate 6 is turned under the resilient force of spring 11 until the turning of the one end of the arcuate hole 8 of the turning plate is blocked with projection 10 of disc portion 2 of first joint member a. Then, both joint members a and b are pivoted with respect to each other to an angle of 120°, whereby large projections 17 are inserted into corresponding engaging hole 9 and small projections 16 are inserted into corresponding engaging hole 18 of reinforcing rim 19 and into the outer portion of overlapping double engaging hole 13, as explained in the situation where the joint members are pivoted to an angle of 60°.

In the situation for unfolding the ladder to an angle of 180°, it is operated in a similar manner.

When it is desired to fold the ladders, joint members a and b are pivoted toward each other while knob 15 is pushed inwardly.

From the foregoing it can be seen that the present invention provides an improved positioning joint for a folding ladder which insures safety in use while being easy to operate. Clearly, many modifications and variations of the invention are made possible in the light of the above teachings. It is therefore to be understood that, within the scope of the appended claims, the invention may be practiced otherwise then as specifically described.

It is claimed:

1. A positioning joint for a folding ladder comprising a first joint member having a tubular portion and two spaced first and second disc portions each having a central bore, a second joint member having a tubular portion and a disc portion with a central bore, the disc portion of the second joint member being disposed between the disc portions of the first joint member and comprising first and second sidewalls, a hollow shaft inserted into the central bores of the disc portions of the first and second joint members, a turning plate between an inner wall of the first disc portion of said first joint member and the first sidewall of the disc portion of the second joint member, said turning plate having a plurality of engaging holes formed in alignment with engaging holes circumferentially distributed in the first disc portion of the first joint member and having an arcuate hole into which a projection on the first disc portion of the first joint member projects, the second disc portion of said first joint member having a plurality of engaging holes formed in a reinforcing rim, said disc portion of the second joint member having a pair of engaging holes in the first sidewall facing the turning plate such that they can align with engaging holes of the turning plate and having a pair of overlapping double holes in the second sidewall such that its radially innermost hole aligns with the engaging hole of said first sidewall, said hollow shaft having a spring about itself by which a central portion of a crank-shaped strip is fixed and having a pair of axially elongated holes, a push knob inserted into said hollow shaft, said push knob having a pin hole into which a pin is inserted in alignment with said axially elongated holes, said crank-shaped strip having a small projection on each end which is adapted to be inserted into said engaging holes of the reinforcing rim and the outer portion of said overlapping double holes and having a pair of large projections formed radially inwardly from said small projections, the large projections each adapted to be inserted into the inner portion of said overlapping double holes and in said engaging hole of the first sidewall of the disc portion of the second joint member and corresponding engaging holes of the turning plate and corresponding engaging holes of the first disc portion of the first joint member, and a spring between said turning plate and the first disc portion of the first joint member.

2. A positioning joint in accordance with claim 1 wherein the second sidewall of the disc portion of the second joint member includes a bore in which a portion of the crank shaped strip rotates.

* * * * *